US010240459B2

(12) United States Patent
Satake et al.

(10) Patent No.: US 10,240,459 B2
(45) Date of Patent: Mar. 26, 2019

(54) SWASH-PLATE HYDRAULIC MOTOR OR SWASH-PLATE HYDRAULIC PUMP

(71) Applicant: NABTESCO CORPORATION, Tokyo (JP)

(72) Inventors: Teruhiko Satake, Gifu (JP); Takuhiro Karino, Gifu (JP)

(73) Assignee: Nabtesco Corporation, Tokyo (JP)

( * ) Notice: Subject to any disclaimer, the term of this patent is extended or adjusted under 35 U.S.C. 154(b) by 351 days.

(21) Appl. No.: 14/654,659

(22) PCT Filed: Dec. 26, 2012

(86) PCT No.: PCT/JP2012/083593

§ 371 (c)(1),
(2) Date: Jun. 22, 2015

(87) PCT Pub. No.: WO2014/102923

PCT Pub. Date: Jul. 3, 2014

(65) Prior Publication Data

US 2015/0308271 A1 Oct. 29, 2015

(51) Int. Cl.
*F03B 3/00* (2006.01)
*F01B 3/00* (2006.01)
(Continued)

(52) U.S. Cl.
CPC ..... *F01B 3/0055* (2013.01); *F01B 3/007* (2013.01); *F01B 3/106* (2013.01); *F03C 1/0668* (2013.01);
(Continued)

(58) Field of Classification Search
CPC ..... F01B 3/0055; F01B 3/007; F01B 3/106; F03C 1/0668; F03C 1/0671; F04B 1/2078; F04B 1/2085; F04B 1/32
USPC ..... 92/13
See application file for complete search history.

(56) References Cited

U.S. PATENT DOCUMENTS 2,604,047 A * 7/1952 Beaman ..... F04B 1/2007 417/206
3,256,782 A * 6/1966 Ebert ..... F01B 3/007 91/505
(Continued)

FOREIGN PATENT DOCUMENTS

CN 1168714 A 12/1997
CN 101006272 A 7/2007
(Continued)

OTHER PUBLICATIONS

Translation of JP 2002048054 A.*
(Continued)

*Primary Examiner* — Kenneth J Hansen
*Assistant Examiner* — Benjamin Doyle
(74) *Attorney, Agent, or Firm* — Pillsbury Winthrop Shaw Pittman, LLP

(57) ABSTRACT

The present invention addresses the problem of providing a swash-plate hydraulic motor or a swash-plate hydraulic pump having a structure in which the swash plate can be stably held without mounting a shoe to the swash plate-side end of a tilt control piston. An example of the embodiment of the present invention is a swash-plate hydraulic motor (1). A spherical section (8*b*) is integrally formed on the swash plate-side end surface of a tilt piston (8), and a groove (10) into which the spherical section (8*b*) is fitted in a slidable manner is formed in the support surface (7*b*) (second support surface (7*b*2)) of the swash plate (7). The groove (10) is a part of the second support surface (7*b*2) and has a shape having a predetermined width and having a longitudinal direction which is oriented perpendicularly to the direction which connects two pivots (11).

7 Claims, 3 Drawing Sheets

(51) Int. Cl.

| | |
|---|---|
| ***F04B 1/32*** | (2006.01) |
| ***F04B 1/20*** | (2006.01) |
| ***F03C 1/06*** | (2006.01) |
| ***F01B 3/10*** | (2006.01) |

(52) U.S. Cl.
CPC ..... *F03C 1/0671* (2013.01); *F04B 1/2078* (2013.01); *F04B 1/2085* (2013.01); *F04B 1/32* (2013.01)

(56) References Cited

U.S. PATENT DOCUMENTS

| | | | | | |
|---|---|---|---|---|---|
| 3,935,796 | A * | 2/1976 | Wood | F04B 1/2064 91/504 |
| 4,581,980 | A * | 4/1986 | Berthold | F04B 1/324 91/506 |
| 5,095,807 | A * | 3/1992 | Wagenseil | F01B 3/0032 417/222.1 |
| 5,184,536 | A * | 2/1993 | Arai | F04B 1/2085 417/222.1 |
| 5,630,707 | A * | 5/1997 | Kim | F04B 1/2085 417/269 |
| 5,826,488 | A * | 10/1998 | Arai | F04B 1/2085 417/269 |
| 6,435,074 | B1 | 8/2002 | Tanaka et al. | |
| 2005/0257684 | A1* | 11/2005 | Sugiura | C10M 103/00 92/71 |
| 2009/0304529 | A1 | 12/2009 | Shimazaki et al. | |
| 2015/0152730 | A1* | 6/2015 | Diebold | F01B 3/007 91/473 |
| 2015/0308271 | A1* | 10/2015 | Satake | F04B 1/32 417/269 |

FOREIGN PATENT DOCUMENTS

| | | | | |
|---|---|---|---|---|
| JP | S10-1517 | | 2/1935 | |
| JP | H06-229368 | A | 8/1994 | |
| JP | 1054344 | * | 2/1998 | F04B 1/20 |
| JP | H10-54344 | A | 2/1998 | |
| JP | 2002048054 | A * | 2/2002 | |
| JP | 2003-113773 | A | 4/2003 | |
| JP | 2003113772 | A * | 4/2003 | |
| JP | 2003113773 | A * | 4/2003 | |
| JP | 2003-148327 | A | 5/2003 | |
| JP | 2003-322081 | A | 11/2003 | |
| JP | 2004-169654 | A | 6/2004 | |
| KR | 2000-0048047 | A | 7/2000 | |

OTHER PUBLICATIONS

Translation of JP 2003113773 A.*
Translation of JP 2003113772 A.*
Notice of Reasons for Rejection as issued in Japanese Patent Application No. 2011-269714, dated Aug. 18, 2015.
First Office Action as issued in Chinese Patent Application No. 201280078056.8, dated Jun. 21, 2016.
International Search Report as issued in International Patent Application No. PCT/JP2012/083593, dated Apr. 16, 2013.
International Preliminary Report on Patentability and the Written Opinion of the International Searching Authority as issued in International Patent Application No. PCT/JP2012/083593, dated Jul. 9, 2015.
Notification of Reasons for Refusal issued in corresponding Korean Patent Application No. 10-2015-7017859 dated Jan. 15, 2019 with English translation.

* cited by examiner

Enlarged cross section taken at the A-A line in FIG. 2A

SWASH-PLATE HYDRAULIC MOTOR OR SWASH-PLATE HYDRAULIC PUMP

CROSS-REFERENCE TO RELATED APPLICATION

This application is the U.S. National Stage of PCT/JP2012/083593, filed Dec. 26, 2012. The content of this application is incorporated herein by reference in its entirety.

TECHNICAL FIELD

The present invention relates to a swash-plate hydraulic motor or a swash-plate hydraulic pump, which is used for construction vehicles such as hydraulic excavators.

BACKGROUND

The swash-plate hydraulic motor or the swash-plate hydraulic pump includes a tilt piston for changing the tilt angle of a swash plate. In, for example, a swash-plate hydraulic motor (1) recited in Patent Literature 1, a swash plate (12) is in point-contact with a tilt control piston (14B).

CITATION LIST

Patent Literature

[Patent Literature 1] Japanese Unexamined Patent Publication No. 2004-169654

SUMMARY OF THE INVENTION

Technical Problem

When the swash plate (12) is in point-contact with the tilt control piston (14B) as descried in Patent Literature 1, the attitude of the swash plate (12) may be unstable depending on the state of a hydraulic pressure applied to the cylinder. On this account, to an end portion on the swash plate side of the tilt control piston, typically a shoe which is in surface-contact with the swash plate is rotatably attached. While this shoe prevents the attitude of the swash plate from becoming unstable, it incurs cost increase.

The present invention has been done to solve the problem above, and an object of the present invention is to provide a swash-plate hydraulic motor or a swash-plate hydraulic pump which is structured so that a swash plate is stably retained without requiring the attachment of a shoe to an end portion on the swash plate side of a tilt control piston.

Technical Solution

To solve the problem above, the present invention provides a swash-plate hydraulic motor or a swash-plate hydraulic pump including: a main body casing; a rotation axis housed in the main body casing; a cylinder block attached to the rotation axis; cylinder holes formed in the cylinder block; pistons slidably inserted into the cylinder holes; shoes attached to leading ends of the pistons; a swash plate including a slope on which the shoes slide and a supported surface which is formed on the side opposite to the slope and is supported by the main body casing via two pivots; a tilt piston which is in contact with the supported surface of the swash plate and is configured to tilt the swash plate by pressing the swash plate toward the pistons; and a cylinder hole for the tilt piston, which is formed in the main body casing and to which the tilt piston is slidably inserted, a spherical surface member being formed at an end face on the swash plate side of the tilt piston in an integrated manner, a recess with which the spherical surface member is slidably engaged being formed in the supported surface of the swash plate.

According to this arrangement, the contact area between the tilt piston and the swash plate is enlarged as compared to the known arrangements, without attaching a shoe to the end portion on the swash plate side of the tilt piston. With this, the swash plate is stably retained while the cost is reduced as compared to the known arrangements.

Furthermore, in the present invention, preferably, the bottom surface of the recess is formed to be arc-shaped to be identical in shape with the spherical surface member, in a direction of connecting the two pivots with each other, and is formed to be flat, in a direction orthogonal to the direction of connecting the two pivots with each other.

According to this arrangement, the force of retaining the swash plate is improved in the direction of connecting the two pivots with each other, and the traveling distance of a part where the spherical surface member of the tilt piston is in contact with the swash plate is reduced and the abrasion of this part is reduced, in the direction orthogonal to the direction of connecting the two pivots with each other.

Furthermore, in the present invention, preferably, a curvature radius of the bottom surface of the recess is larger than a curvature radius of the spherical surface member and is 1.56 times of the curvature radius of the spherical surface member or smaller.

With this arrangement, the attitude of the swash plate becomes stable and local contact between the spherical surface member of the tilt piston and the swash plate is restrained, with the result that the abrasion of the contact part is restrained.

Advantageous Effect of Invention

In the present invention, a spherical surface member is formed at an end face on the swash plate side of a tilt piston in an integrated manner, and a recess with which the spherical surface member is slidably engaged is formed in a supported surface of the swash plate. This allows a swash-plate hydraulic motor or a swash-plate hydraulic pump to be able to stably retain the swash plate, without attaching a shoe to an end portion on the swash plate side of the tilt piston (tilt control piston).

PREFERRED EMBODIMENT OF INVENTION

The following will describe an embodiment of the present invention with reference to figures. A swash-plate hydraulic motor 1 (swash-plate hydraulic rotating machine) described below is a variable-capacity hydraulic motor which is used for running system of a construction vehicle such as a hydraulic excavator, and is switchable between two speeds, i.e., fast and slow. The present invention is applicable not only to the swash-plate hydraulic motor but also to a swash-plate hydraulic pump.

(Structure of Swash-Plate Hydraulic Motor)

Figure 1:
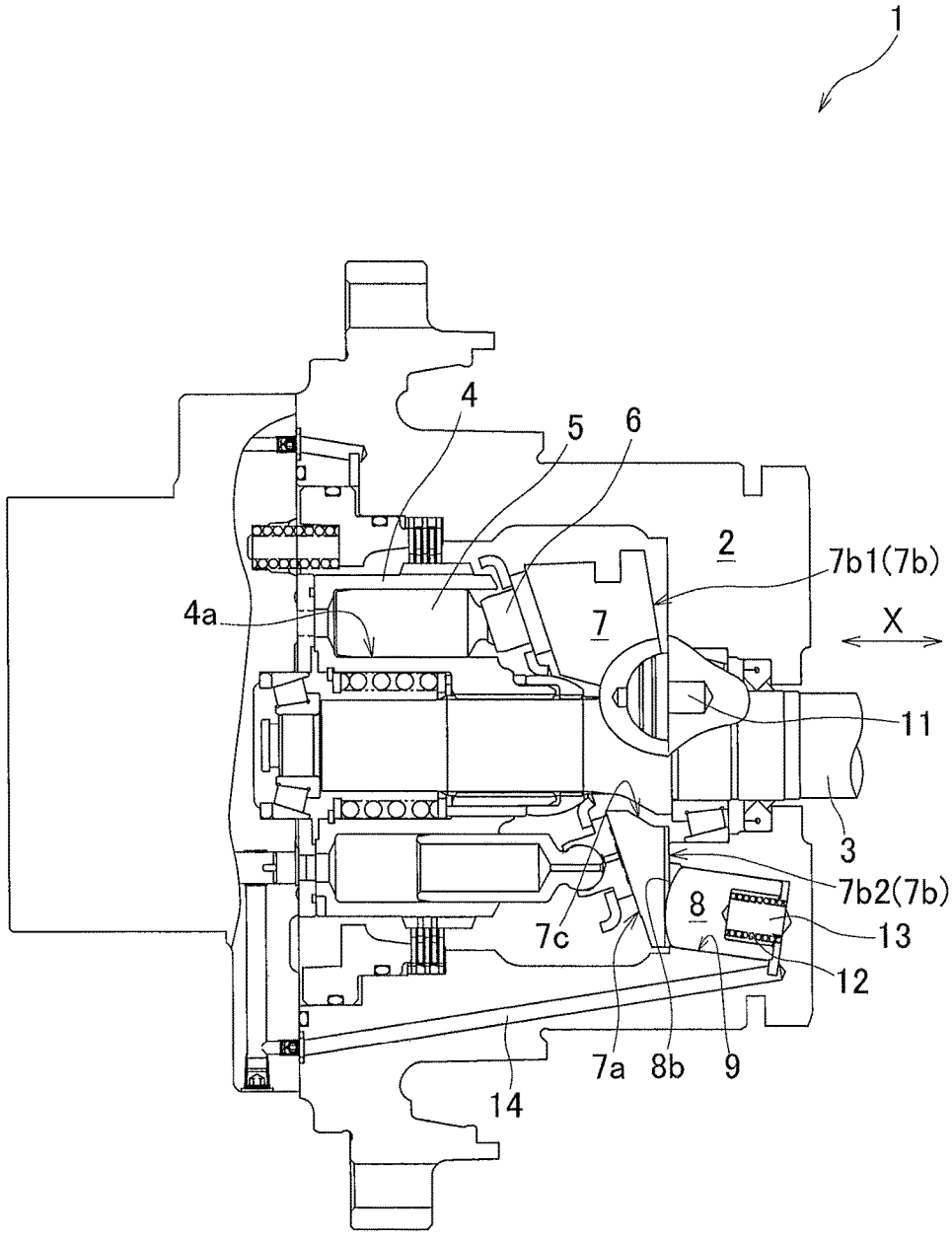
FIG. 1 is a cross section of a swash-plate hydraulic motor of an embodiment of the present invention.
Figure 2B:
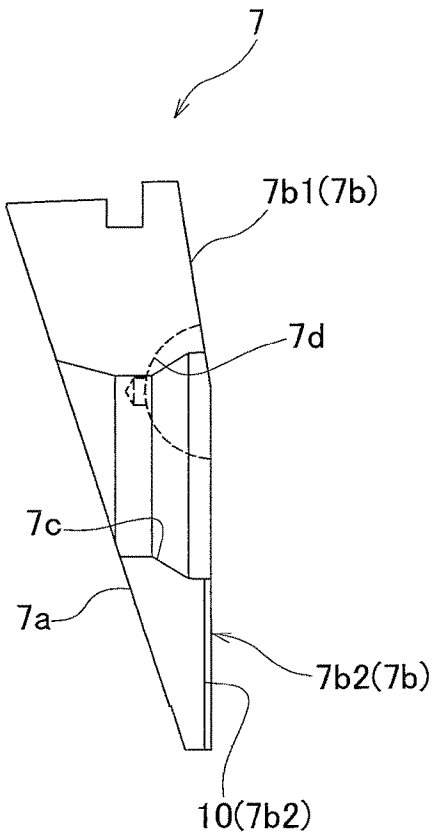
FIG. 2 shows a swash plate which is a part of the swash-plate hydraulic motor shown in FIG. 1.
Figure 2A:
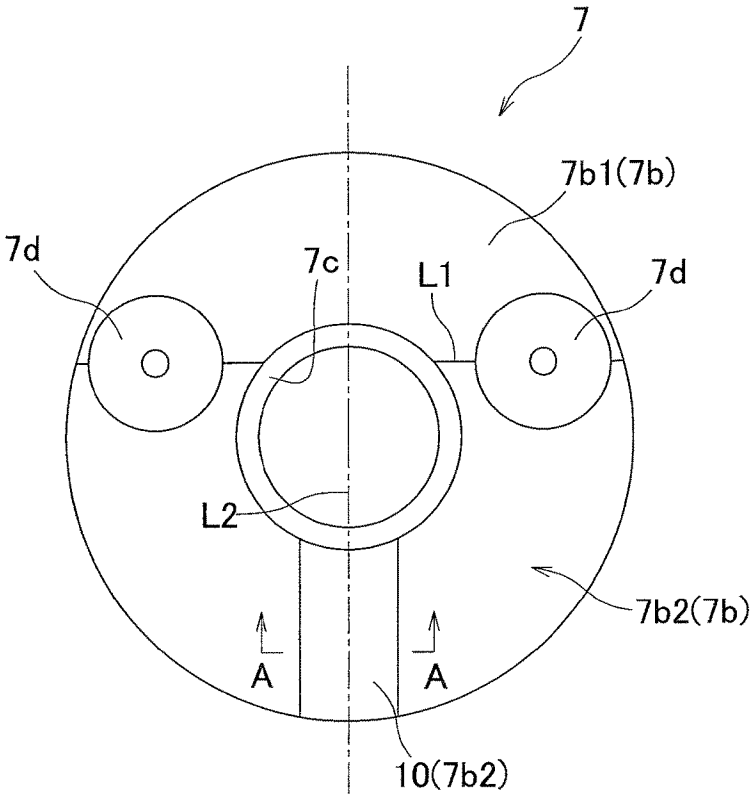

FIG. 1 is a cross section of the hydraulic motor 1 of the embodiment of the present invention, and FIG. 2 shows a swash plate 7 which is a part of the hydraulic motor 1. FIG. 2A is a front elevation of the swash plate 7, whereas FIG. 2B is a sectional side elevation of the swash plate 7.

As shown in FIG. 1, the hydraulic motor 1 includes members such as a main body casing 2, a rotation axis 3, a cylinder block 4, pistons 5, shoes 6, a swash plate 7, and a tilt piston 8.

(Main Body Casing and Rotation Axis)

The main body casing 2 is provided to house the rotation axis 3, the cylinder block 4, the pistons 5, the swash plate 7, and the like, and the rotation axis 3 is supported to be rotatable with respect to the main body casing 2.

(Cylinder Block)

The cylinder block 4 is spline-connected to the rotation axis 3, and is attached to the rotation axis 3 to be movable in the axial direction X of the rotation axis 3 and to be rotatable together with the rotation axis 3 in the rotational direction of the rotation axis 3. Furthermore, around the shaft center of the cylinder block 4, a plurality of cylinder holes 4*a* are formed to extend in the axial direction. These cylinder holes 4*a* are provided on a single circumference at regular intervals. Each cylinder hole 4*a* is formed in the cylinder block 4 so that the longitudinal direction of the cylinder hole 4*a* is in parallel to the axial direction X.

(Pistons and Shoes)

Plural pistons 5 are inserted into the respective cylinder holes 4*a* to be slidable on the inner wall surfaces of the cylinder holes 4*a*. To a spherical member formed at the leading end of each piston 5, a shoe 6 is attached.

(Swash Plate)

As shown in FIGS. 1 and 2, the swash plate 7 includes a slope 7*a* on which the shoes 6 slide and a supported surface 7*b* which is formed on the side opposite to the slope 7*a* and is supported by the main body casing 2. The swash plate 7 has an annular shape when viewed in the axial direction X, and has a hole 7*c* which is penetrated by the rotation axis 3.

As pressure oil is supplied to and discharged from each of the cylinder holes 4*a* of the cylinder block 4, the piston 5 inserted into that cylinder hole 4*a* reciprocates. In accordance with the reciprocation of the piston 5, the shoe 6 rotates while sliding on the slope 7*a* of the swash plate 7, with the result that the piston 5 rotates. The rotation of the pistons 5 causes the cylinder block 4 to rotate, and the rotation axis 3 rotates together with the cylinder block 4.

The supported surface 7*b* of the swash plate 7 is formed of a first supported surface 7*b*1 and a second supported surface 7*b*2 which are two surfaces different from each other in terms of the angle with respect to the axial direction X of the rotation axis 3. On the both sides of the rotation axis 3, pivots 11 are provided to be on an intersecting line L1 on which the first supported surface 7*b*1 intersects with the second supported surface 7*b*2 and to be slidable on the supported surface 7*b* of the swash plate 7. These two pivots 11 are fixed to the main body casing 2. The swash plate 7 is arranged to be swingable with the two pivots 11 as fulcrums, between a position where the first supported surface 7*b*1 is in contact with the main body casing 2 and a position (see FIG. 1) where the second supported surface 7*b*2 is in contact with the main body casing 2.

In two pivot holes 7*d* shown in FIG. 2, the pivots 11 are slidably provided, respectively. The two pivots 11 (pivot holes 7*d*) are symmetrical with each other in the left-right direction about a central line L2 which passes through the center of the rotation axis 3.

(Tilt Piston)

In the inner wall surface of the main body casing 2, a tilt piston cylinder hole 9 which is circular in cross section and to which the tilt piston 8 is slidably inserted is provided at a part of the inner wall surface where the second supported surface 7*b*2 of the swash plate 7 is in contact with the main body casing 2. Into this tilt piston cylinder hole 9, a tilt piston 8 is inserted to press the swash plate 7 toward the piston 5 in order to tilt (swing) the swash plate 7.

Figure 3:
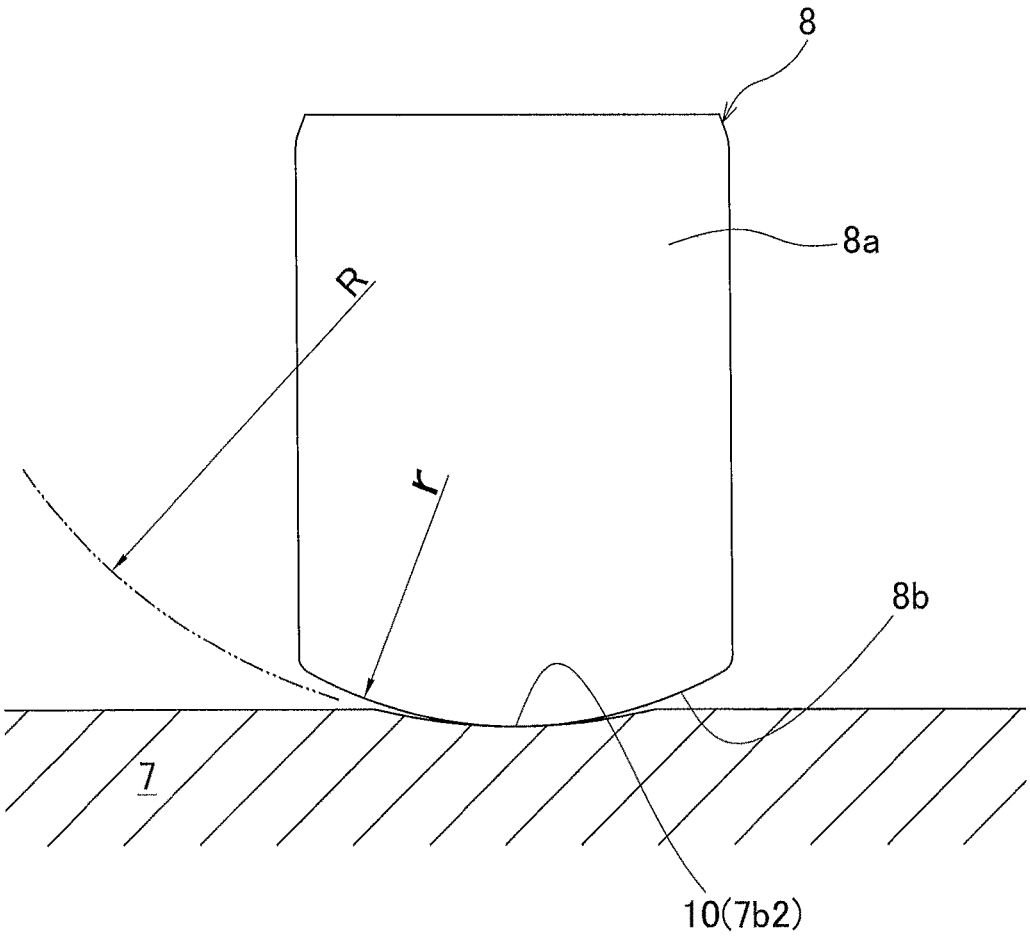
FIG. 3 is an enlarged cross section taken at the A-A line in FIG. 2A.

FIG. 3 is an enlarged cross section taken at the A-A line in FIG. 2A, and shows the tilt piston 8 which is in contact with the second supported surface 7*b*2 of the swash plate 7. As shown in FIGS. 1 and 3, the tilt piston 8 includes a main body 8*a* which is partially cylindrical in shape and slides on the inner wall surface of the tilt piston cylinder hole 9 and a spherical surface member 8*b* which is formed on an end face on the swash plate 7 side of the main body 8*a* to be integrated with the main body 8*a*. Integrating the spherical surface member 8*b* with the main body 8*a* indicates that the tilt piston 8 including the main body 8*a* and the spherical surface member 8*b* is made from a single material (steel material) by casting, forging, or carving. In other words, the main body 8*a* and the spherical surface member 8*b* are not members which are independently formed.

As shown in FIG. 1, between the tilt piston 8 and the bottom surface of the tilt piston cylinder hole 9, a back pressure chamber 13 is formed so that pressure oil for moving the tilt piston 8 is introduced therein. The pressure oil for moving the tilt piston 8 is introduced into the back pressure chamber 13 via an oil passage 14 formed in the main body casing 2. Furthermore, in the back pressure chamber 13 (tilt piston cylinder hole 9), a spring 12 (coil spring) is provided. The tilt piston 8 is always biased toward the swash plate 7 by this spring 12, and is always in contact with the second supported surface 7*b*2 of the swash plate 7. The tilt piston 8 presses the swash plate 7 toward the piston 5 when a switching valve (not illustrated) is switched and the pressure oil is supplied to the back pressure chamber 13 via the oil passage 14. With this, the tilt angle of the swash plate 7 is changed and the hydraulic motor 1 is switched from the low speed to the high speed. When the supply of the pressure oil to the back pressure chamber 13 is stopped, the oil is removed from the back pressure chamber 13 and the tilt piston 8 moves back, with the result that the tilt angle of the swash plate 7 is changed and the hydraulic motor 1 is switched from the high speed to the low speed. FIG. 1 shows a case where the swash plate is at the low speed position.

(Concave Groove Formed in Supported Surface of Swash Plate)

As illustrated in FIGS. 2 and 3 with a reference sign, in the second supported surface 7*b*2 of the swash plate 7, a concave groove 10 with which the spherical surface member 8*b* of the tilt piston 8 is slidably engaged is formed.

This concave groove 10 is a part of the second supported surface 7*b*2, and is a groove-shaped recess which is long in the direction of connecting the two pivots 11 with each other and has a predetermined width. The concave groove 10 is formed to extend from the center of the rotation axis 3 toward the outer circumference of the swash plate 7. That is to say, between the hole 7*c* of the swash plate 7 and the outer circumference of the swash plate 7, the concave groove 10 with a predetermined width is formed in the second supported surface 7*b*2 of the swash plate 7. The bottom surface of the concave groove 10 is arc-shaped in the direction of connecting the two pivots 11 with each other, and this arc shape corresponds to the shape of the spherical surface member 8*b* of the tilt piston 8 (see FIG. 3). The bottom surface of the concave groove 10 is flat in shape in the direction orthogonal to the direction of connecting the two pivots 11 (see FIG. 2).

(Advantageous Effects)

In the hydraulic motor 1 of the present embodiment, the contact area between the swash plate 7 and the tilt piston 8 is large as compared to the hydraulic motor recited in Patent Literature 1 (Japanese Unexamined Patent Publication No. 2004-169654). With this, the attitude of the swash plate 7 which swings with the two pivots 11 as fulcrums becomes stable. In other words, the swash plate 7 is stably retained. Because it is unnecessary to attach, to an end portion on the swash plate side of the tilt piston 8, a shoe which is in surface-contact with the swash plate 7, the swash plate 7 is stably retained while cost reduction is achieved.

In addition to the above, because the contact area between the swash plate 7 and the tilt piston 8 is increased, the abrasion resistance of the swash plate 7 is improved. As a result, it becomes less necessary to perform a hardening process such as thermal treatment for the swash plate 7. The cost is therefore further reduced. Furthermore, the abrasion of the swash plate is reduced only by adding simple components which are the tilt piston 8 integrated with the spherical surface member 8*b* and the swash plate 7 in which the concave groove 10 is formed.

In addition to the above, because the concave groove 10 of the present embodiment is formed as a recess in the supported surface of the swash plate 7, the force of retaining the swash plate 7 is improved in the direction of connecting the two pivots 11 with each other, and the traveling distance of a part where the spherical surface member 8*b* of the tilt piston 8 is in contact with the swash plate 7 is reduced and the abrasion of this part is reduced, in the direction orthogonal to the direction of connecting the two pivots 11 with each other (i.e., in the direction in which the central line L2 extends).

It is noted that, instead of a groove with a predetermined width in shape (the concave groove 10), the recess which is formed in the second supported surface 7*b*2 of the swash plate 7 and with which the spherical surface member 8*b* of the tilt piston 8 is engaged may be spherical in shape in the same manner as the spherical surface member 8*b*.

(Relationship Between Curvature Radius of Bottom Surface of Concave Groove and Curvature Radius of Spherical Surface Member of Tilt Piston)

The curvature radius R of the bottom surface of the concave groove 10 is preferably larger than the curvature radius R of the spherical surface member 8*b* of the tilt piston 8 and not larger than 1.56 times of the curvature radius R of the spherical surface member 8*b*. To be more specific, when, for example, the curvature radius R of the spherical surface member 8*b* of the tilt piston 8 is 24.5 mm (i.e., ϕ49 mm in the spherical diameter), the curvature radius R of the bottom surface of the concave groove 10 is preferably not smaller than 25 mm (which is 1.02 times of the curvature radius R of the spherical surface member 8*b*) and not larger than 38 mm (i.e., not smaller than 50 mm and not larger than 76 mm in diameter).

With this, the attitude of the swash plate 7 becomes stable and local contact between the spherical surface member 8*b* of the tilt piston 8 and the swash plate 7 is restrained, with the result that the abrasion of the contact part is restrained. It is noted that, when the bottom surface of the concave groove 10 is arc-shaped, it is indicated that the curvature radius R of the bottom surface of the concave groove 10 is constant over the entirety of the width of the concave groove 10 (i.e., entirely constant in the direction of connecting the two pivots 11 with each other). In a similar manner, in regard to the tilt piston 8, when the end face thereof on the swash plate side is the spherical surface member 8*b*, it is indicated that the curvature radius R of the end face on the swash plate side is constant over the entirety of the end face on the swash plate side.

In addition to the above, further preferably, the curvature radius R of the bottom surface of the concave groove 10 is 1.3 times of the curvature radius R of the spherical surface member 8*b* or larger, and is 1.56 times of the curvature radius R of the spherical surface member 8*b* or smaller. For example, when the curvature radius R of the spherical surface member 8*b* is 24.5 mm (i.e., ϕ49 mm in the spherical diameter), the curvature radius R of the bottom surface of the concave groove 10 is preferably not smaller than 32 mm and not larger than 38 mm (not smaller than 64 mm and not larger than 76 mm in diameter).

This makes it possible to prevent the spherical surface member 8*b* of the tilt piston 8 from hitting corners of the concave groove 10 (i.e., the both ends in the width direction of the concave groove 10) even if the machining error of the shape of the pivot 11 is relatively large.

In addition to the above, when the curvature radius R of the bottom surface of the concave groove 10 is larger than the curvature radius R of the spherical surface member 8*b* of the tilt piston 8 and is 1.56 times of the curvature radius R of the spherical surface member 8*b* or smaller, or when the curvature radius R of the bottom surface of the concave groove 10 is 1.3 times of the curvature radius R of the spherical surface member 8*b* or larger and 1.56 times of the curvature radius R of the spherical surface member 8*b* or smaller, the curvature radius R of the spherical surface member 8*b* is preferably not smaller than 24.5 mm (ϕ49 mm in the spherical diameter) and not larger than 30 mm (ϕ60 mm in the spherical diameter).

This further restrains the traveling distance of the part where the spherical surface member 8*b* of the tilt piston 8 is in contact with the swash plate 7, and restrains the lateral load exerted to the tilt piston 8. As a result, increase in the surface pressure applied to the inner side surface of the tilt piston cylinder hole 9 formed in the main body casing 2 is restrained, and hence the abrasion of the tilt piston cylinder hole 9 is restrained.

REFERENCE SIGNS LIST

1: HYDRAULIC MOTOR (SWASH-PLATE HYDRAULIC MOTOR)
2: MAIN BODY CASING
3: ROTATION AXIS
4: CYLINDER BLOCK
5: PISTON
6: SHOE
7: SWASH PLATE
7*b*: SUPPORTED SURFACE
7*b*1: FIRST SUPPORTED SURFACE
7*b*2: SECOND SUPPORTED SURFACE
8: TILT PISTON
8*b*: SPHERICAL SURFACE MEMBER
9: CYLINDER HOLE FOR TILT PISTON
10: CONCAVE GROOVE (RECESS)

The invention claimed is:

1. A swash-plate hydraulic motor or a swash-plate hydraulic pump comprising:

a main body casing;

a rotation axis housed in the main body casing;

a cylinder block attached to the rotation axis;

cylinder holes formed in the cylinder block;

pistons slidably inserted into the cylinder holes;

shoes attached to leading ends of the pistons;

a swash plate including a slope on which the shoes slide and a supported surface which is formed on the side opposite to the slope and is supported by the main body casing via two pivots;

a tilt piston which is in contact with the supported surface of the swash plate and is configured to tilt the swash plate by pressing the swash plate toward the pistons; and a cylinder hole for the tilt piston, the cylinder hole being formed in the main body casing and into which the tilt piston is slidably inserted, a spherical surface member being formed at an end face on the swash plate side of the tilt piston in an integrated manner, a recess with which the spherical surface member is slidably engaged, the recess being formed in the supported surface of the swash plate, wherein a bottom surface of the recess is formed to be arc-shaped in a direction connecting the two pivots with each other, and wherein the bottom surface of the recess is formed to be flat in a direction orthogonal to the direction connecting the two pivots with each other over an entire length of the recess, and wherein the tilt piston is configured to be movable between an extended position in which the tilt piston presses the swash plate towards the pistons and a retracted position, wherein, as the tilt piston moves between the extended position and the retracted position and the swash plate pivots about the two pivots, the spherical surface member of the tilt piston is configured to engage the bottom surface of the recess at different positions of the recess, and wherein the different positions are spaced apart longitudinally in the direction orthogonal to the direction connecting the two pivots with each other.

2. The swash-plate hydraulic motor or a swash-plate hydraulic pump of claim 1, wherein the supported surface of the swash plate includes a first supported surface and a second supported surface, each of the first and second supported surfaces make a different angle with respect to the rotation axis.

3. The swash-plate hydraulic motor or a swash-plate hydraulic pump of claim 2, wherein the swash plate is arranged to be swingable with the two pivots as fulcrums, between a first position where the first supported surface is in contact with the main body casing and a second position where the second supported surface is in contact with the main body casing.

4. The swash-plate hydraulic motor or a swash-plate hydraulic pump of claim 2, wherein the recess is formed on the second supported surface.

5. The swash-plate hydraulic motor or a swash-plate hydraulic pump of claim 1, wherein the recess extends, longitudinally in the direction orthogonal to the direction connecting the two pivots with each other, from the center of the rotation axis to an outer circumference of the swash plate.

6. The swash-plate hydraulic motor or a swash-plate hydraulic pump of claim 1, wherein the recess has a pre-determined width, and wherein the arc-shaped bottom surface of the recess has a radius of curvature that is constant over the entirety of the pre-determined width of the recess and in the direction connecting the two pivots with each other.

7. The swash-plate hydraulic motor or a swash-plate hydraulic pump of claim 1, wherein the bottom surface of the recess has a first radius of curvature and the spherical surface member of the tilt piston has a second radius of curvature, wherein the first radius of curvature of the bottom surface of the recess is different from the second radius of curvature of the spherical surface member of the tilt piston.

* * * * *